United States Patent [19]

Galiegue et al.

[11] Patent Number: 4,938,356

[45] Date of Patent: Jul. 3, 1990

[54] PACKAGING DEVICE OF THE TRAY TYPE FOR A PLURALITY OF ARTICLES, MORE PARTICULARLY FOR POTS CONTAINING FRESH MILK PRODUCTS SUCH AS YOGHURTS OR SIMILAR

[75] Inventors: Daniel Galiegue, Les Clayes-Sous-Bois; Eric Thiry, Paris, both of France

[73] Assignee: Compagnie Gervais Danone, Levallois-Perret, France

[21] Appl. No.: 264,594

[22] Filed: Oct. 31, 1988

[30] Foreign Application Priority Data

Oct. 29, 1987 [FR] France ..... 87 14984
Jul. 6, 1988 [FR] France ..... 88 09146

[51] Int. Cl.[5] ..... B65D 75/00

[52] U.S. Cl. ..... 206/429; 206/158; 206/194; 206/197; 206/427

[58] Field of Search ..... 206/150, 158, 162, 194, 206/196, 197, 198, 427, 434, 429; 229/52 BC

[56] References Cited

U.S. PATENT DOCUMENTS

| | | | |
|---|---|---|---|
| 2,456,610 | 7/1945 | Baker . | |
| 3,094,210 | 6/1963 | Van Den Berg | 206/162 |
| 3,108,690 | 10/1963 | Dunn | 206/194 |
| 3,432,202 | 3/1969 | Ebelhardt | 206/158 |
| 3,463,306 | 8/1969 | Taylor | 206/434 |
| 3,587,847 | 6/1971 | Graser | 206/194 |
| 3,698,550 | 10/1972 | Graser | 206/158 |
| 4,382,511 | 5/1983 | Hamelin et al. | 206/427 |
| 4,596,356 | 6/1986 | Chaussadas | 206/194 |
| 4,756,419 | 7/1988 | LeBras | 206/196 |

FOREIGN PATENT DOCUMENTS

| | | | |
|---|---|---|---|
| 1084008 | 10/1979 | Canada . | |
| 109499 | 4/1968 | Denmark | 206/158 |
| 0271895 | 12/1987 | European Pat. Off. . | |
| 8220102 | 11/1982 | Fed. Rep. of Germany . | |
| 2138409 | 1/1973 | France . | |
| 2570351 | 3/1986 | France . | |

*Primary Examiner*—David T. Fidei
*Attorney, Agent, or Firm*—Browdy and Neimark

[57] ABSTRACT

The invention provides a packaging device for individual containers comprising a cardboard, plastic material or similar blank with a surface formed with orifices through which said containers pass and grooved along two continuous or discontinuous lines defining two strips, which, after bending form two short parallel flaps with tongues coming from the cut-outs forming said orifices in the blank and adapted to be erected therefrom opposite the flaps, said containers—held in said orifices—are further supported by said flaps or said tongues bearing under an external projection of the containers, which tongues act in the manner of buttresses or stays, by bearing on a zone of small extent of the projection, and the total height of the tongues and flaps by which the device may rest on a display surface or any appropriate support is substantially equal to the height of said containers.

4 Claims, 6 Drawing Sheets h
143
135
140
13
13
l 116
114
118
120
133
134
135
122
124
126
121
123
125
132
117
119
130

143
135
140
P
142
150
P
144
s
141

PACKAGING DEVICE OF THE TRAY TYPE FOR A PLURALITY OF ARTICLES, MORE PARTICULARLY FOR POTS CONTAINING FRESH MILK PRODUCTS SUCH AS YOGHURTS OR SIMILAR

BACKGROUND OF THE INVENTION

1. Field of the Invention

The invention relates to packaging of the tray type for a plurality of individual articles, particularly pots containing fresh milk products such as yoghurts or similar.

Numerous embodiments are already known of packaging devices formed from a cardboard blank shaped as a case which envelopes totally or partially a plurality of articles joined together at the time of manufacture, e.g. pots of yoghurts or other milk based products, and which are disposed in the package in assemblies of pots superimposed on each other. If, on the other hand, it is desired to combine in a packaging device not containers joined together, but unit containers which must be held simply and reliably in said package from their manufacture to their purchase by the user, on the one hand, and to be able to be readily taken hold of individually by said user, on the other hand, said device being further of sufficiently low cost to make economic use thereof possible, then difficulties arise which cannot be overcome by known devices for packaging containers initially joined together at the time of their manufacture. Such is further the case for unit containers or holders which, like the fresh milk product packages, are plastic material pots having at their upper part a bead, for heat sealing a cover, projecting radially about the opening of the pot.

2. Description of the Prior Art

To solve the problem raised, the patent FR-A No. 2 570 351 has already proposed for example a device of the tray type comprising a flat part pierced with orifices for maintaining each container transversely in position, as well as means for axially and unidirectionally holding said containers in position. Although such a device is satisfactory for holding containers, it can however only be manufactured from a large sized blank and is thus costly in raw material, since the device comprises a surface parallel to that having the transverse holding openings, on the one hand, and since, on the other hand, additional material zones are provided for joining together the last mentioned surface and the plane with the openings so as to form a case structure. In addition, the device described in said document is not provided for allowing the superimpositioning of trays one on the other in the same simple-to-use package, in particular as far as its closure is concerned.

A device has also been proposed in U.S. Pat. No. 3,432,202 for packaging individual containers, in this case beer cans, comprising a cardboard blank with a surface formed with orifices through which said containers pass and grooved along two lines defining two strips which, after folding, form two short parallel flaps with tongues provided by the cut-outs forming said orifices in the blank and erected opposite the flaps. A device in accordance with this patent does not make "tray" presentation possible, coherence of the package being obtained by the beer cans bearing against each other at their lower portion distant from their support by the tongues.

The problem exists then of providing a packaging device of the tray type, but of a sufficiently simple structure so as not to increase its cost prohibitively on the one hand, and, on the other hand, well adapted to the formation of "tray" packages superimposed by using a wrapping enveloping them at least partially.

SUMMARY OF THE INVENTION

A general object of the invention is consequently to provide a packaging device overcoming this problem.

A further obJect of the invention is to provide a device for packaging a plurality of articles, such as yoghurt pots or similar, in which said objects or pots are held simply and reliably in position in their longitudinal direction, the device further lending itself particularly well to use in automatic packaging machines.

A further object of the invention is to provide such a device which is easy to handle by the user not only for the assembly of packed products but also for the individual products which it contains.

A last object of the invention is to provide such a device whose cost is comparable, if not less, than that of known devices, particularly by the fact that it is made from a cardboard, plastic material or similar blank of relatively small area and so of a limited raw material cost.

The problem is solved in accordance with the invention by a packaging device for individual containers comprising a cardboard, plastic material or similar blank with a surface formed with orifices through which said containers pass and grooved along two lines defining two strips, which, after bending form two short parallel flaps with tongues coming from the cut-outs forming said orifices in the blank and adapted to be erected therefrom opposite the flaps, characterized in that the containers held in said orifices are further supported by said flaps or said tongues bearing under an external annular projection of the containers, which tongues then act in the manner of buttresses or stays, by bearing on a zone of small extent of the annular projection, and in that the total height of the tongues and flaps by which the device may rest on a display surface or any appropriate support is substantially equal to the height of said containers.

In a preferred embodiment, said flaps have short spurs advantageously of a trapezoidal shape on their free edge.

The device comprises advantageously at least two rows of orifices in a symmetrical arrangement with respect to the median longitudinal axis of the blank and a tongue and only one is formed from each orifice.

The blank is preferably made from micro-corrugated cardboard.

The invention also provides a package, characterized in that it comprises at least one device of the tray type such as defined above, fitted with a plurality of containers, such as yoghurt pots with beads or similar, the tray being enveloped in a wrapping, the most simply a cardboard blank shaped as a case and the ends of which are either assembled and fixed to each other by any known means or, in a variant, immobilized with respect to the tray properly speaking and the containers which it holds.

A package of this type may be formed by at least two trays, such as defined above, superimposed one on the other and each carrying a plurality of containers and enveloped in a wrapping shaped as a case.

In such a case, and in accordance with another characteristic of the invention, the free edges of the wrapping are provided with lugs for locking said wrapping with respect to the tray by positioning them between the bases or bottoms of two adjacent containers held in the lower tray.

BRIEF DESCRIPTION OF THE DRAWINGS

Other features and advantages of the invention will be clear from the following description given by way of example with reference to the accompanying drawings in which.

DESCRIPTION OF THE PREFERRED EMBODIMENTS

Figure 1:
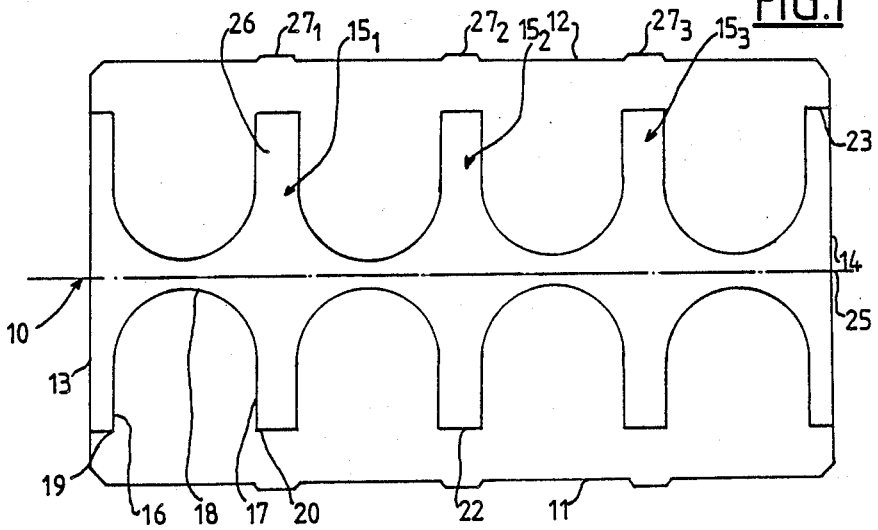
FIG. 1 is a top view of a cardboard, plastic material or similar blank, able to enter into the construction of a device in accordance with the invention.

Reference is first made to FIG. 1 which shows, in a top view, a plastic material, cardboard—advantageously micro-corrugated cardboard—or a similar material blank capable of forming a packaging device in accordance with the invention, of the "tray" type for holding and displaying containers R which the device is intended to hold. Blank 10, with a substantially rectangular contour, is thus defined by sides of large dimensions 11, 12 and sides of small dimensions 13", 14. It is cut out, as shown by lines $15_1$, $15_2$, $15_3$ etc. . . . to form a plurality of orifices O each of which comprises, in the embodiment shown, two substantially parallel edges 16, 17 joined together by a rounded end portion 18, the edges 16, 17 ending at their free ends 19, 20, respectively, in a grooving line 22 which extends—while being interrupted in line with orifices O—from one end to the other of the blank between sides 13 and 14. Since the device is a mirror image with respect to a median axis 25, it also has a grooving line 23 parallel to line 22 and cut-outs which define orifices O also symmetrical with those which have just been described with respect to the median axis 25. As can also be seen in FIG. 1, the large dimension sides 11 and 12 are formed substantially facing solid portions 26 of the blank, between two adjacent cut-outs $15_1$ and $15_2$ to form short spurs $27_1$, $27_2$, $27_3$ . . . with a substantially trapezoidal contour in a plane view.

The grooving lines 22 and 23 make it possible to form blank 10 into a "tray" by folding said blank along said lines; during this operation, the material of the blank inside the cut-out lines 15 is then erected from the grooving lines 22, 23 to form a plurality of tongues $30_1$, $30_2$, $30_3$, etc. . . . (eight in number in the example described and shown) FIG. 2, each associated with orifice O, the rest of blank 10 between the orifices O, the grooving lines 22, 23 and the small dimension sides 13, 14 forming a surface or tray 31, whereas the portions of the blank between the grooving lines and the large dimension sides 11, 12 form flaps 32 and 33, respectively, FIGS. 2 and 3.

Figure 2:
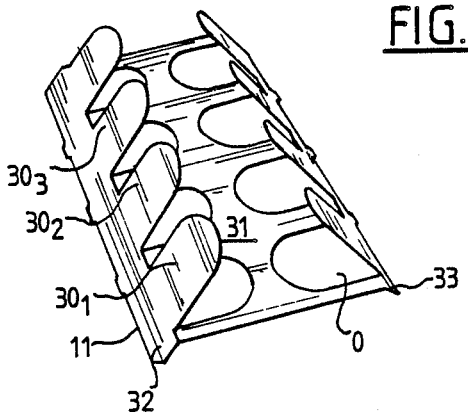
FIG. 2 is a view of said blank, after partial erection of the tongues forming a buttress or stay buttressing the containers which the device is intended to hold.
Figure 3:
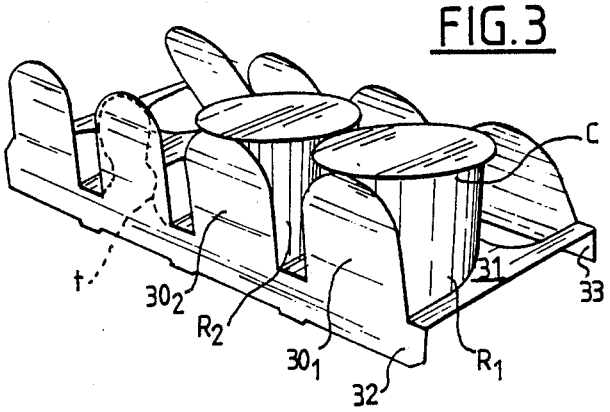
FIG. 3 illustrates how a first series of containers is held in the device of the tray type for a first method of using the device.

When, from the half open condition shown in FIG. 2, the tongues 30 symmetrical with respect to a longitudinal median plane passing through the axis 25 are moved further away from each other and, in fact, brought substantially perpendicularly to the "tray" 31, the containers R may be introduced into the orifices O (FIG. 3) for immobilizing them with respect to a transverse movement, whereas immobilization of said containers $R_1$ and $R_1$ with respect to a downward longitudinal or axial movement—i.e. directed substantially orthogonally to tray 31—is obtained by means of tongues $30_1$ and $30_2$ which each cooperate, respectively, with an external projecting portion of the container. In the embodiment described and shown, this proJecting portion is the bead C of the container R, which is provided about the opening thereof and which serves mainly for heat sealing a closure film on the container, in particular when it is a question of pots containing yoghurt or similar milk based products, such an indication of course having no limitative character. Tongues 30 which only bear on a zone of small extent of bead C support containers R in the manner of buttresses or stays.

Figure 4:
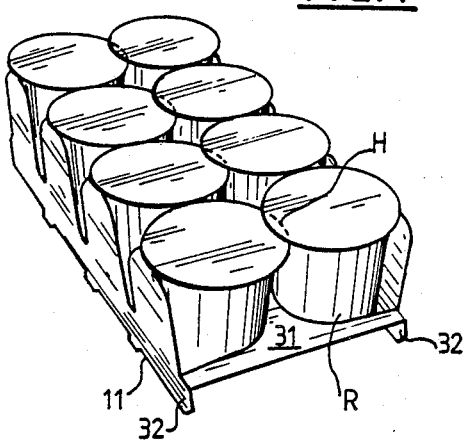
FIG. 4 is a view similar to that of FIG. 3, but showing the device with all its containers.

When, in the case of a packaging device with two rows of four pots each, the whole of tray 31 is fitted with containers R, the condition is the one shown in FIG. 4 in which beads C of adjacent pots of the same row or of two adjacent rows, overlap as shown schematically at H and in which the flaps 32 and 33, opposite the tongues 30 and directed downwards, form means by which the device stands on a display unit.

Overlapping such as H increases the rigidity of the whole of the device to which also contributes the fact that tongues 30 which bear under beads C, in the manner of buttresses or stays, tend, because of the very resilience of the material forming the device, to exert compression forces forcing said tongues towards each other and, consequently, bringing the facing containers of two adjacent rows closer together.

The axial holding effect of containers R in the packaging device and also the action developed by said tongues tending to bring the pots closer together may of course be obtained by means of tongues having another shape than that described and shown, provided that their height is sufficient to allow them to bear under the bead or another projecting part of the container, the total height of tongues 30 and flaps 32, 33 being substantially equal to the height of containers R. The tongues may be cut out, during preparation of the micro-corrugated cardboard or similar material blank, e.g. as shown schematically at t in FIG. 3 so as to provide an advertising pattern, which may also be printed on a portion or on the whole of the tongue as desired.

The arrangement of orifices O is of course in no wise limited to that described and shown. Thus, for a device intended to assemble a large number of individual articles together, complementary cut-outs may be provided in blank 10, advantageously in the central region of the blank, and thus between containers or lateral rows of containers. In such a construction, the orifices provided for receiving these complementary containers may be pre-cut out so that, after insertion of the container in the corresponding orifice, the material of the blank inside said cut-out forms lugs of a height corresponding to that of the flaps 32, 33 and which contribute to the bearing of the "tray" device standing on a display surface. In this construction, also, the axial holding of the complementary containers placed in said orifices in the central zones of the blank is then provided by beads or other projecting portions of these containers bearing on the same portions of the other containers, by overlapping zones similar to those described above.

Figure 5:
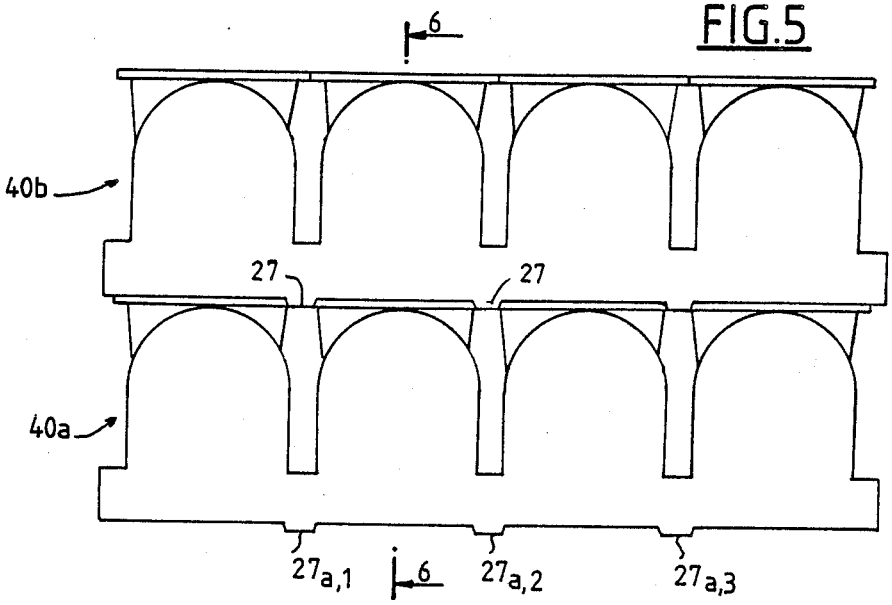
FIG. 5 is a view of a package incorporating two superimposed devices of the tray type such as illustrated in the preceding figures.
Figure 6:
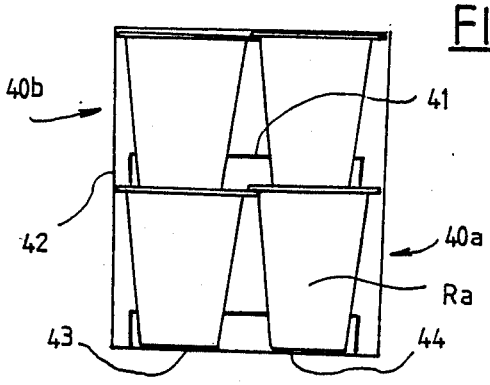
FIG. 6 is a sectional view through line 6—6 of FIG. 5.

The device of the invention further lends itself particularly well to the construction of a package comprising several such superimposed devices, enveloped in a common wrapping, as shown by way of example in FIGS. 5 and 6. In this construction, a first tray device **40*a* such as described above has thereover a second identical device 40*b* so as to form a unit package with sixteen containers. Tray 41 of device 40*b* rests by its flaps 32, 33 on the containers of device 40*a* and the two devices 40*a* and 40*b* are enclosed in a wrapping 42 whose ends 43 and 44 are either bonded together as shown in FIG. 6, or are secured by locking tabs, staples or other means known per se. Spurs 27 of device 40*b* placed between the beads of containers Ra of the tray device 40*a* oppose the longitudinal movement of the two devices with respect to each other, whereas spurs $27a_1$, $27a_2$, $27a_3$ etc. . . . of device 40*a* positioned in corresponding apertures formed in the wrapping 42** provide longitudinal locking of the lower "tray" device with respect to said wrapping.

Figure 7:
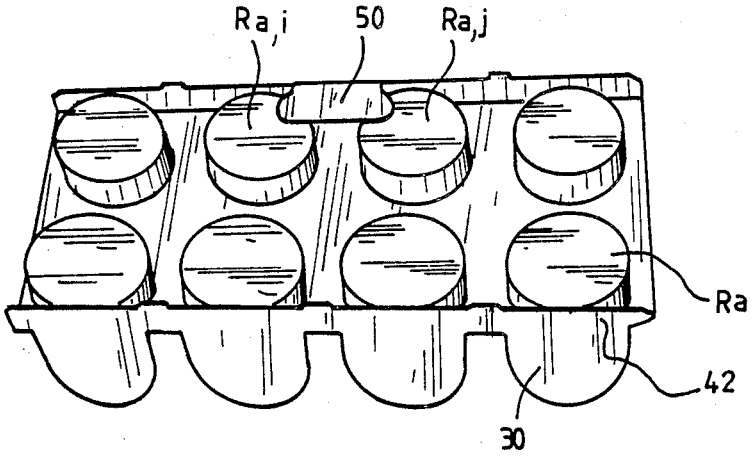
FIG. 7 is a schematic bottom view illustrating a device for locking the wrapping envelope in a first condition.
Figure 8:
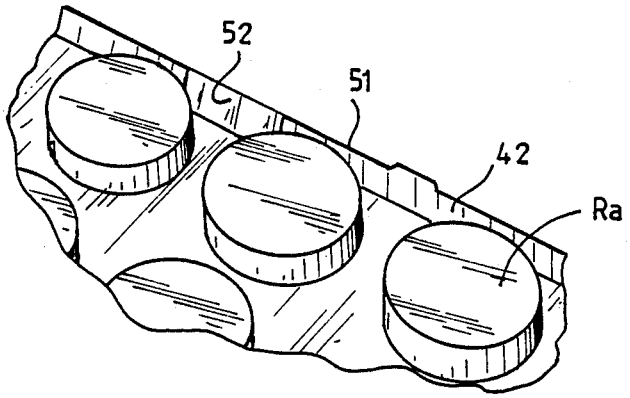
FIG. 8 is a view similar to that of FIG. 7 for another condition, namely locking.

In the variant of construction shown in FIGS. 7 and 8, closure of wrapping 42 is not obtained by means of the usual tabs, bonding or stapling of the free edges of said wrapping, but by means of lugs 50 hinged along fold lines 52 on the opposite longitudinal edges 51 of the wrapping and which are formed so as to be housed in the bottoms of adjacent containers Ra,i and Ra,j of the lower layer of containers. For this, lugs 50 have a somewhat "hammer" shaped contour, which, when said lugs are bent back from the condition shown in FIG. 7 to be brought into the condition shown in FIG. 8, can no longer be removed accidentally and, therefore, ensure positioning of the wrapping with respect to the two tray devices.

Whatever the form of construction and closure of the wrapping, the presence of tongues 30 makes it possible to transmit the compression forces via the thickness of the bead of the containers, so that, since the latter carry practically no weight, they may be formed using less material and therefore under better economic conditions.

Figure 9:
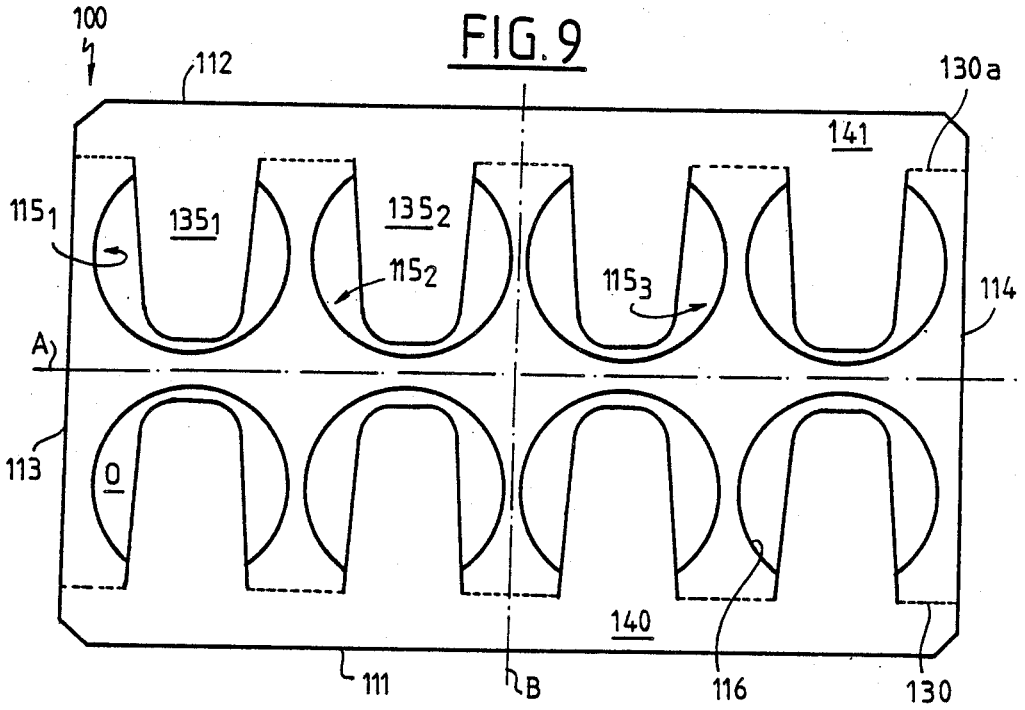
FIG. 9 is a top view similar to that of FIG. 1, but for a constructional variant.
Figure 10:
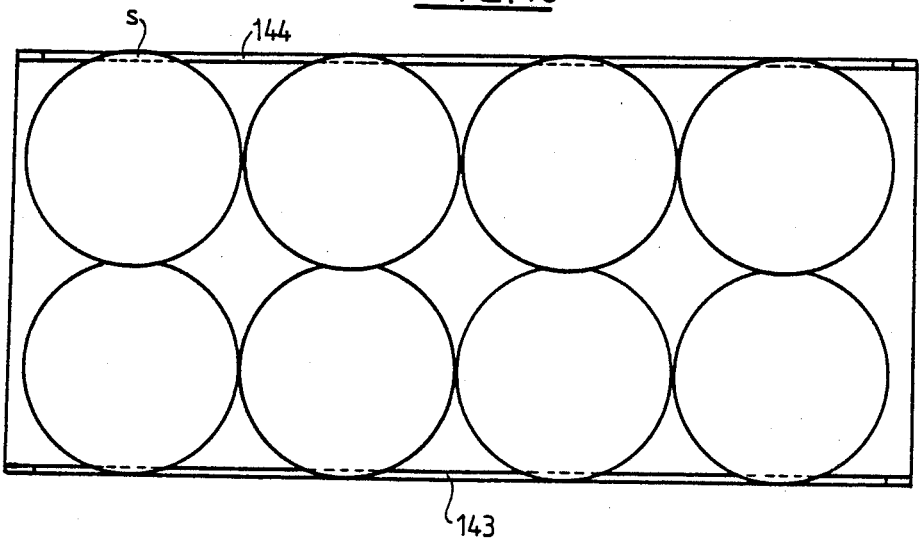
FIG. 10 is a top view of the device formed from the blank shown in FIG. 9 in its operating condition.
Figure 11:
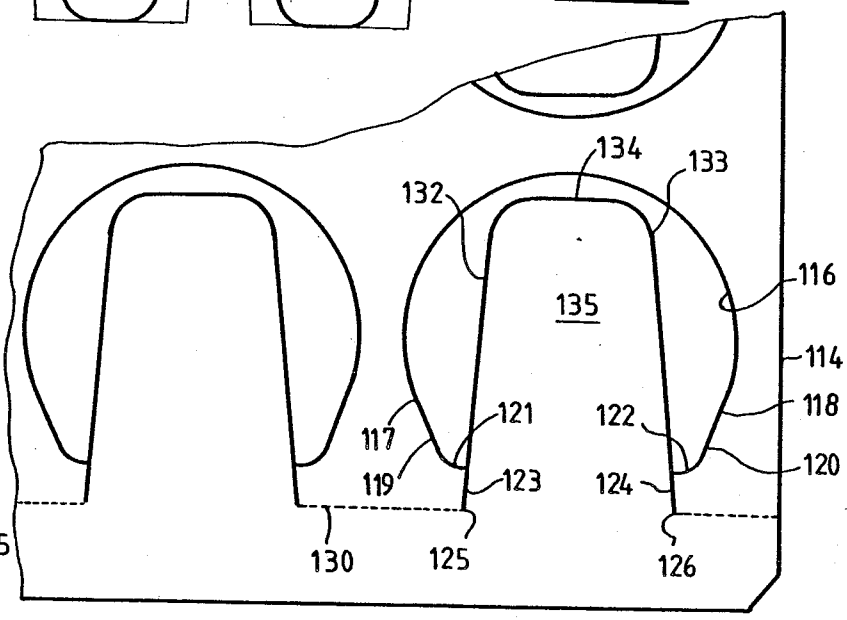
FIG. 11 is a partial view of FIG. 9 on a larger scale.

Reference will now be made to FIGS. 9 and 11 which show, in a plane view, a variant of the plastic material, cardboard—advantageously micro-corrugated cardboard—or similar material blank intended for another method of use of the packaging device of the invention for holding and displaying a plurality of articles, particularly pots P. Blank 100, with a substantially rectangular contour, is thus defined by large dimension sides 111 and 112 and small dimension sides 113 and 114. It is cut out, as shown, by lines $115_1$, $115_2$, $115_3$, to form a plurality of orifices O each of which comprises, in the embodiment described and shown, a portion 116 in the form of an arc of a circle of great angular extent whose ends 117 and 118 are extended by rectilinear segments 119 and 120 respectively, which themselves continue at first by bends 121 and 122, respectively, then by short rectilinear segments 123 and 124 ending at their ends 125 and 126 in a grooving line 130. The latter extends from one end to the other of the blank, between sides 113 and 114 while being interrupted in line with orifices O which, as can be clearly seen in FIG. 9, are disposed mirror image fashion with respect to a longitudinal median axis A of the blank and also with respect to a transverse median axis B parallel to sides 113 and 114.

Segments 123 and 124 are extended, away from the grooving line 30, by edges 132 and 133 joined together at their ends by a side 134 so as to define tongues $135_1$, $135_2$, $135_3$, etc. . . . each associated with an orifice O and eight in number in the example described and shown.

The grooving lines 130 and **130*a* make it possible to shape blank 100 in the form of a "tray" 142 by folding said blank along said lines. During this operation, the portions 140 and 141 of the blank between the longitudinal edges 111 and 112 and the grooving lines 130 and 130*a*, respectively, are erected along flaps or bent portions of short height h, FIGS. 12 and 13, whereas tongues 135 are opened out in the plane of said flaps, but downwards if the flaps are erected upwards. The "tray" 142 receives the articles such as pots P in its orifices 8 which hold said articles in position transversely, whereas in the longitudinal direction—which is substantially the vertical direction in the drawings—they are held in position by edges 143 and 144, respectively, of flaps 140 and 141** under an external projection s of the articles or pots P.

In the case of use of the device for packing pots such as yoghurt pots, this projecting portion s is advantageously the bead provided about the opening of the pot which serves, mainly, for heat sealing a closure film or cover.

Figure 12:
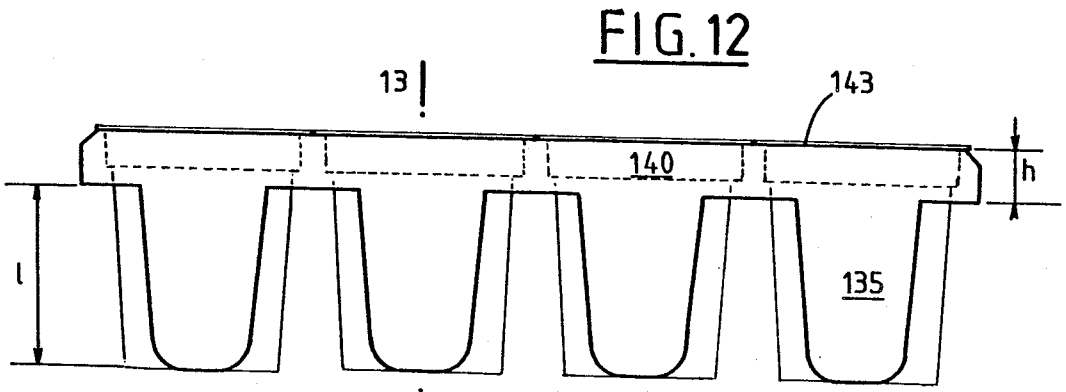
FIG. 12 is a side view of the device shown in FIG. 10.
Figure 13:
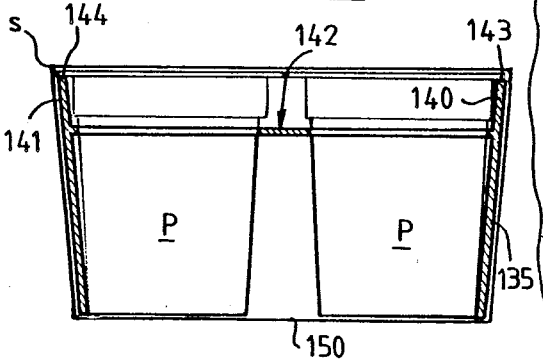
FIG. 13 is a sectional view through line 13—13 of FIG. 12.

As can be clearly seen in FIGS. 12 and 13, the length l of tongues 135 is chosen so that the sum l+h is less than or substantially equal to the longitudinal dimension of the articles or pots P to be packed so that the device may be completed by a wrapping 150, the most simply a cardboard blank shaped in the form of a case whose ends are assembled and or fixed together preferably at the upper part of the package, i.e. in the vicinity of the beads of pots P.

Figure 14:
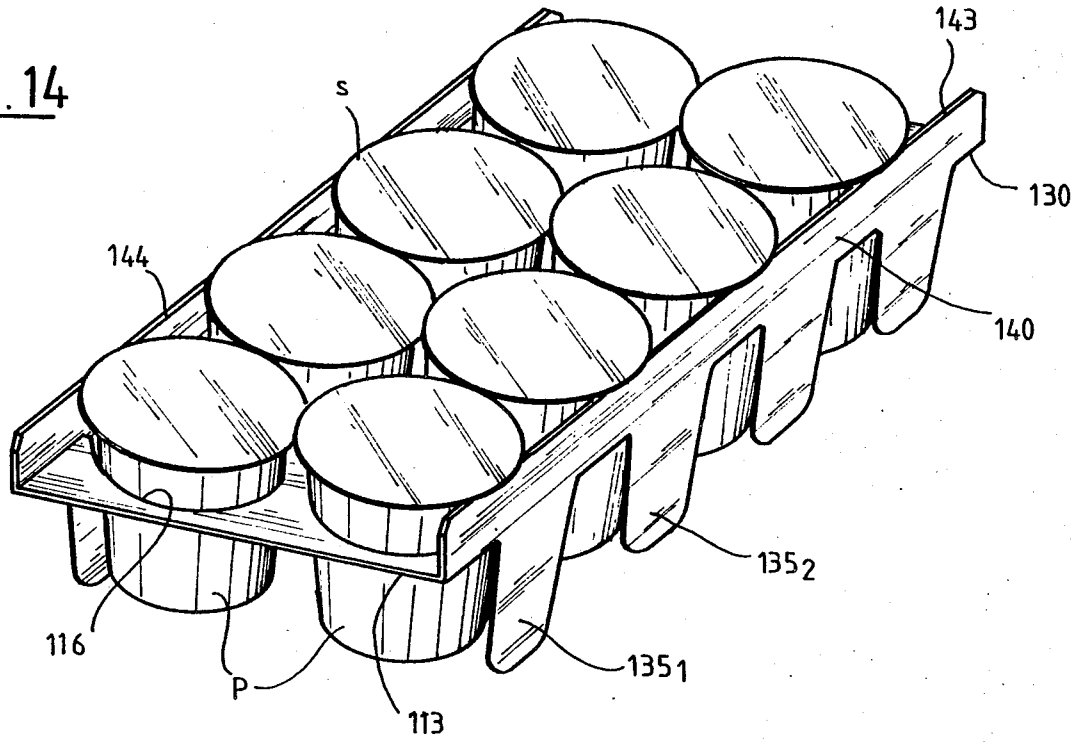
FIG. 14 is a schematic perspective view of the device shown in FIGS. 10, 12 and 13.

The shape described and shown of tongues 135 is of course only given by way of non limitative example, since said tongues may be cut out, during preparation of the micro-corrugated cardboard or similar material blanks, in identical or different designs, depending on the requirements of practice, particularly for obtaining advertising effects if the wrapping is made from a transparent material, such effects being complementary to that of protecting the packed articles or pots provided by the tongues which, in the operating condition of the device, are adjacent said articles or pots, as can be seen in FIG. 14.

The structure of the device of the invention makes it possible to use it in automatic packaging machines having means for bending simply about the grooving lines 130 and 130*a*.

The invention is of course not limited to the embodiment described and shown, particularly in so far as the general contour of the plane 100 is concerned which may be substantially square, instead of rectangular, e.g. for packing four pots instead of the eight illustrated.

What is claimed is:

1. A packaging device for displaying and carrying individual containers having a given height and an external projection at one end, said packaging device comprising at least one cardboard, plastic or similar material blank, having a substantially rectangular shape with parallel longitudinal edges and parallel transversal edges and orifices adapted to lodge said containers;

two grooved folding lines on said blank parallel to said longitudinal edges;

two short parallel flaps of said blank between said folding lines and said longitudinal edges;

tongues in number as the number of orifices formed by cut-outs of said orifices and a surface of said blank between said grooved folding lines and said orifices;

said blank foldable along said grooved lines that each said flap and said tongue lies in a plane substantially perpendicular to said surface of said blank;

walls with each of said walls formed by one of said flaps and said tongues starting from the same said folding line having a total height substantially equal to a height of said containers;

each of the external projections of the containers partly resting on only one of said flaps.

2. A packaging device for displaying and carrying individual containers having a given height and an external projection at one end, said packaging device comprising at least one cardboard, plastic or similar material blank, having a substantially rectangular shape with parallel longitudinal edges and parallel transversal edges and orifices adapted to lodge said containers;

two grooved folding lines on said blank parallel to said longitudinal edges;

two short parallel flaps of said blank between said folding lines and said longitudinal edges;

tongues in number as the number of orifices formed by cut-outs of said orifices and a surface of said blank between said grooved folding lines and said orifices;

said blank foldable along said grooved lines that each said flap and said tongue lies in a plane substantially perpendicular to said surface of said blank;

walls with each of said walls formed by one of said flaps and said tongues starting from the same said folding line having a total height substantially equal to a height of said containers;

short projections of substantially trapezoidal shape formed along said longitudinal edge of each of said flaps.

3. A packaging device for displaying and carrying individual containers having a given height and an external projection at one end, said packaging device comprising at least one cardboard, plastic or similar material blank, having a substantially rectangular shape with parallel longitudinal edges and parallel transversal edges and orifices adapted to lodge said containers;

two grooved folding lines on said blank parallel to said longitudinal edges;

two short parallel flaps of said blank between said folding lines and said longitudinal edges;

tongues in number as the number of orifices formed by cut-outs of said orifices and a surface of said blank between said grooved folding lines and said orifices;

said blank foldable along said grooved lines that each said flap and said tongue lies in a plane substantially perpendicular to said surface of said blank;

walls with each of said walls formed by one of said flaps and said tongues starting from the same said folding line having a total height substantially equal to a height of said containers;

at least two of said blanks and containers associated with said blanks;

the containers and said blanks superposed on one another;

a wrapping blank of cardboard or the like material formed as a tubular casing around said blanks and containers;

said wrapping blank formed as a tubular casing having lug means on ends of said wrapping blank to lock said wrapping blank with respect to the containers by positioning said lug means adjacent and between the bases of two of the underlying and adjacent containers.

4. A packaging device for displaying and carrying individual containers having a given height and an external projection at one end, said packaging device comprising at least one cardboard, plastic or similar material blank, having a substantially rectangular shape with parallel longitudinal edges and parallel transversal edges and orifices adapted to lodge said containers;

two grooved folding lines on said blank parallel to said longitudinal edges;

two short parallel flaps of said blank between said folding lines and said longitudinal edges;

tongues in number as the number of orifices formed by cut-outs of said orifices and a surface of said blank between said grooved folding lines and said orifices;

said blank foldable along said grooved lines that each said flap and said tongue lies in a plane substantially perpendicular to said surface of said blank;

walls with each of said walls formed by one of said flaps and said tongues starting from the same said folding line having a total height substantially equal to a height of said containers;

said orifices located in adjacent positions to each other in proximity to allow the external projections on the container ends to have a portion in overlapping relationship to the containers in adjacent orifices.

* * * * *